US006520171B2

(12) United States Patent
Reible

(10) Patent No.: US 6,520,171 B2
(45) Date of Patent: Feb. 18, 2003

(54) PNEUMATIC PROJECTILE LAUNCHING APPARATUS WITH PARTITION APPARATUS AND OPPOSED-PISTON REGULATOR

(76) Inventor: James Patrick Reible, 1539 Ganesha Pl., Pomona, CA (US) 91768

( * ) Notice: Subject to any disclaimer, the term of this patent is extended or adjusted under 35 U.S.C. 154(b) by 0 days.

(21) Appl. No.: 10/067,228

(22) Filed: Feb. 7, 2002

(65) Prior Publication Data

US 2002/0104524 A1 Aug. 8, 2002

Related U.S. Application Data

(60) Provisional application No. 60/267,133, filed on Feb. 7, 2001.

(51) Int. Cl.[7] ..... F41B 11/02
(52) U.S. Cl. ..... 124/73; 124/74
(58) Field of Search ..... 124/73, 74, 75, 124/45, 48, 49, 50, 51.1

(56) References Cited

U.S. PATENT DOCUMENTS 5,339,791 A * 8/1994 Sullivan ..... 124/73
5,509,399 A * 4/1996 Poor ..... 124/74
5,542,406 A * 8/1996 Oneto ..... 124/50
5,572,982 A * 11/1996 Williams ..... 124/74
5,727,538 A * 3/1998 Ellis ..... 124/32
5,778,868 A * 7/1998 Shepherd
5,884,615 A * 3/1999 Casas Salva ..... 124/31
5,890,479 A * 4/1999 Morin ..... 124/31
6,138,656 A * 10/2000 Rice et al. ..... 124/73
6,314,954 B1 * 11/2001 Wang ..... 124/74
6,347,621 B1 * 2/2002 Guthrie ..... 124/48
6,347,622 B1 * 2/2002 Hsueh ..... 124/31
6,371,099 B1 * 4/2002 Lee ..... 124/58

* cited by examiner

*Primary Examiner*—Michael J. Carone
*Assistant Examiner*—Troy Chambers

(57) ABSTRACT

An improved pneumatic launching apparatus is disclosed having both a partition apparatus for enabling a projectile, such as gelatinous-filled capsules used in paintball, to be loaded and readied for expulsion without applying mechanical force and an improved venting-pressure regulator. When the partition apparatus is in a withdrawn, or open, position, an aperture is exposed to allow a projectile of complimentary size and shape to drop into the firing chamber. The shape of the partition is such that a next projectile is gently cradled and separated from the firing chamber during a closing movement. Further, the partition preferably creates a seal that significantly inhibits the escape of pressurized gas during a firing operation. The venting-pressure regulator utilizes opposed pistons with an escape mechanism to allow venting to occur without requiring a separate adjustment.

17 Claims, 16 Drawing Sheets

PNEUMATIC PROJECTILE LAUNCHING APPARATUS WITH PARTITION APPARATUS AND OPPOSED-PISTON REGULATOR

CROSS-REFERENCE TO RELATED APPLICATION

This application claims the benefit of Provisional Patent Application No. 60/267,133, filed Feb. 7, 2001.

BACKGROUND OF THE INVENTION

1. Field of the Invention

This invention relates to compressed gas powered guns or projectile launching apparatuses that propel projectiles, and more specifically to an improved method of loading and readying for expulsion a gelatinous filled capsule.

2. Description of Prior Art

Numerous types of compressed gas powered guns have been developed for use in areas such as marking stock animals, non-lethal crowd control, and the tactical sport of paintball. Marking guns typically use compressed gas to fire a gelatinous capsule containing a marking material which breaks on impact with a target.

Compressed gas guns have attained widespread use in the recreational sport of paintball, an activity in which teams compete against each other. When a player is marked by the opposing team with a gelatinous capsule or pellet, commonly called a paintball, the player is eliminated from the game.

These guns, commonly called paintball markers, generally use a compressed gas cartridge or cylinder as the power source. A paintball pellet, the gelatinous capsule, is propelled from the marker. The paintballs, break on impact with the target, dispersing the material to mark the target.

In general, the prior art compressed gas guns, such as those used for paintball, include a typical firearm-type loading mechanism called a bolt to push the projectile into a barrel before firing and a firing mechanism involving a spring loaded, large mass, hammer used to strike an exhaust valve. There are several distinct disadvantages to these designs:

a.) the bolt configuration is not conductive to loading the paintball pellets because the geometry of a bolt and a falling sphere are conductive to trapping a projectile as the bolt moves forward;

b.) the bolt is predisposed to jamming when capsules are broken while entering the firing chamber;

c.) the bolt and hammer both require extensive maintenance in the form of lubrication and cleaning;

d.) the bolt and hammer have a great amount of reciprocating mass, the momentum of which inhibits accuracy; and e.) they do not use compressed gas efficiently.

The disadvantages of the prior art are described in more detail in the following paragraphs:

a.) In standard bolt design, as a projectile is readied to be loaded, a front view looks like a figure eight with the bottom circle being the firing chamber and the top circle being the projectile to be loaded. As the projectile begins to load, the point of overlap of the ball and the bolt increases. The bolt has no natural lifting or lowering geometry and therefore, cuts, chops, or squashes the projectile.

b.) The bolt-type mechanism's geometry and movement break the gelatinous capsules. Ideally, a projectile will fall completely into an area known as a breech, the area the ball rests in before being forced into the barrel, by the bolt moving forward. One common problem occurs when the bolt moves forward before the pellet is entirely in the breech, and the bolt crushes the paintball. Once the pellet is crushed, the shell and the gelatinous fill are squirted up into the feed conduit, possibly destroying other pellets, into the breech of the gun, and on the bolt itself, possibly impairing function of the gun. The bolt-type mechanism can also lead to jamming the gun. In some cases, the shell of the broken paintball can become trapped between the bolt and the breech wall and prevent the movement of the bolt, effectively preventing the gun from functioning until it is dismantled and cleaned. Original compressed gas guns had the same problem; however, because they used a hand pump method to move the bolt, reset the hammer, and load pellets. Because it happened more slowly, the problem was not as acute. However, the development of semi-automatic firing increased the rate of fire and augmented the problem of damaging pellets as they load.

c.) Typical compressed air guns which use bolts, shuttles, or breech blocks—all of which usually have large mass and move far and fast—require constant maintenance to ensure the bolt and breech are free of debris that may inhibit their movement as well as requiring extensive lubrication to ensure proper operation.

d.) The large-mass bolt must be moved back and forth to allow feeding of the next projectile. This action creates a source of movement in the gun. A second source of movement in the gun occurs as the large-mass hammer is slammed against the valve to create the exhaust cycle. These motions create a jerk before and during the firing cycle that greatly impairs the accuracy.

e.) Bolt mechanism designs use a small amount of gas to reset the bolt and/or hammer or to cycle a secondary valve to reset the bolt and hammer. That gas is exhausted externally and is not used to propel the projectile.

Therefore, it is desirable to provide an improved pneumatic gun or launching apparatus design which eliminates the bolt and hammer, thus eliminating pellet breakage and jams caused by breakage, reducing part ware, and maintenance while improving accuracy.

Prior art has failed to solve this problem because no design to date has effectively eliminated heavy moving parts and effectively employed an alternate means to load the projectiles and activate the exhaust cycle.

In addition, prior art compressed gas guns, such as those used for paintball, include a standard regulator which has several disadvantages:

a.) They employ face seals which commonly trap debris;

b.) The sealing point of the regulator is inconsistent. Because the face of the sealing surface compresses the seal, over time, the point at which the regulator is set changes.

c.) The output is a diaphragm which has no relief mechanism for venting over pressure;

d.) If the regulator has a vent in the system, it requires a separate adjustment which is usually independent of the regulator adjustment.

SUMMARY

The present invention overcomes the problems of prior loading apparatus gun designs by providing an improved loading system that uses a moveable partition to separate a projectile in the firing chamber from the next projectile in the feed conduit and an improved single adjustment, opposed-piston, venting regulator. In accordance with one embodiment, the pneumatic launching apparatus includes a compressed gas source, a feed conduit, a firing chamber, a movable partition, an activation means for the partition, an opposed-piston regulator, and a firing means.

In this improved design, the moveable partition, which in the preferred embodiment is a small, generally flat plate with low mass, requires only a light actuating force. This actuating force or movement means can be pneumatic, magnetic, mechanical, or electronic. The actuating force is far less than that required to damage a projectile, such as a gelatinous-filled capsule used as a paintball. This design eliminates mechanical damage to projectiles as they load into the launching device and, in turn, eliminates jams related to broken projectile debris.

In addition, using low-mass parts that are actuated with low force allows increased accuracy due to greater stability while allowing for lower maintenance.

The design is efficient because all of the gas supplied into the system is used to propel the projectile. In addition, consistency of the launching apparatus is improved by using a single adjustment, opposed-piston regulator that vents overpressure and acts as a failsafe if an input seal fails.

These and other features and advantages of the invention will be more readily apparent upon reading the following description of a preferred embodiment of the invention and upon reference to the accompanying drawings.

BRIEF DESCRIPTION OF THE DRAWINGS

In the drawings, each related figure is identified by the figure number and an alphabetic suffix. Individual components within the figures are identified according to the number of the related figure and the number of the individual component.

DETAILED DESCRIPTION OF THE PREFERRED EMBODIMENT

Features and Advantages

Figure 1:
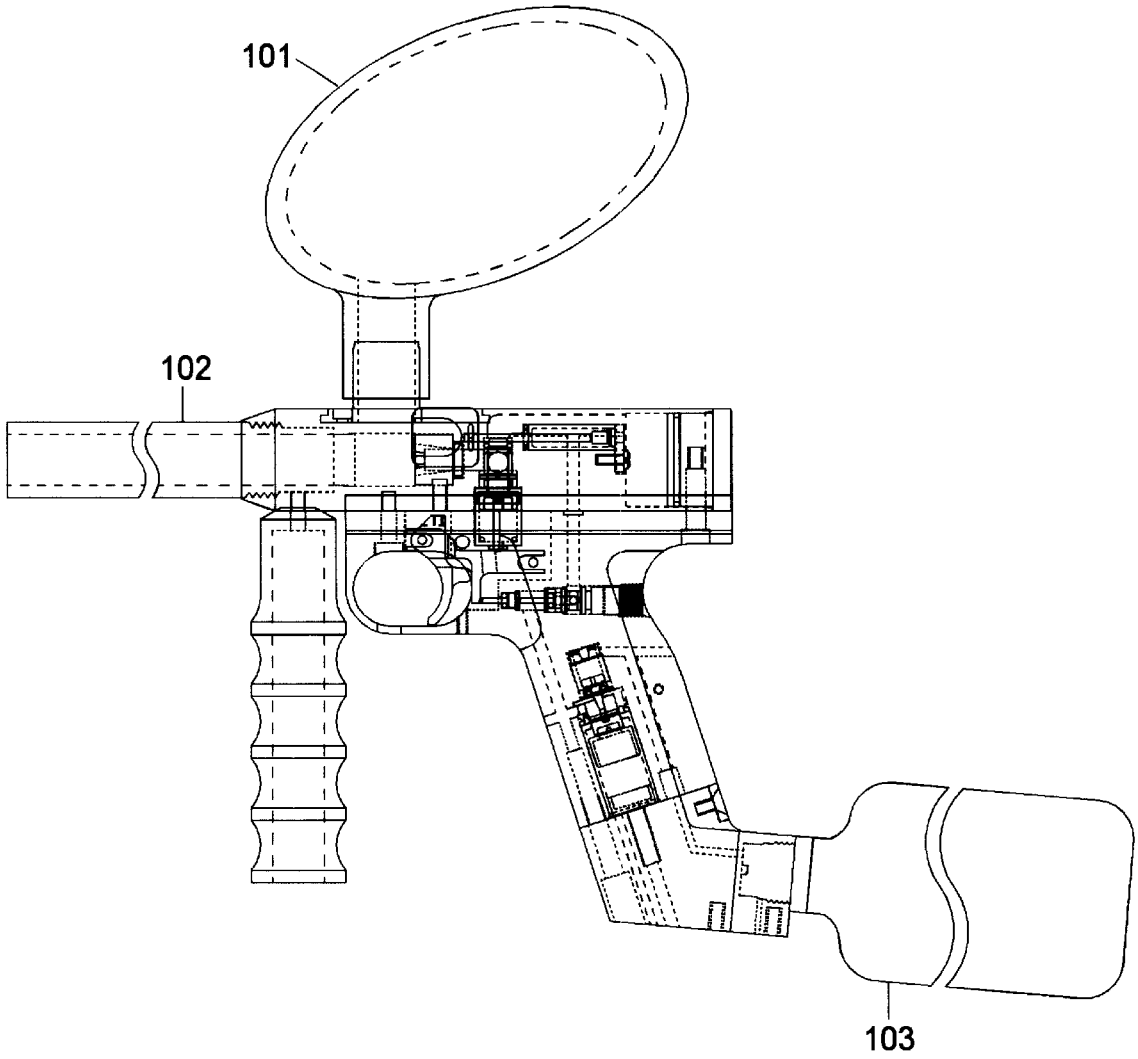
FIG. 1 illustrates a pneumatic launching apparatus with attached barrel, compressed gas system, and projectile storage device.

Accordingly, several features and advantages of this invention are related to the elimination of both the bolt and the hammer, which are large-mass moving parts. By using a small, low-mass, low-force activated partition to separate the projectiles as they load into the firing chamber of the launching apparatus, gelatinous capsules cannot be crushed, and therefore, this type of possible jam is eliminated.

a) The geometry of the movable partition takes advantage of complementary geometry which is conducive to lifting or lowering a projectile which has not fully transferred from the loading aperture to the firing chamber. The movable partition is formed so that it cradles and lifts or lowers the projectile rather than trapping or crushing it.

b.) The light, moveable partition moves forward with less force than required to crush a gelatinous capsule. Thus, the capsule, which is used as the projectile, remains intact. In the rare case that the partition closes directly on the diameter of the projectile, it might be held by the partition, the result being that the launching apparatus will exhaust without a projectile one cycle. The next cycle will release the projectile and allow it to load into the firing chamber.

c.) Since the moveable partition will not crush the projectile, debris from broken projectiles is eliminated and therefore will not jam the launching apparatus.

d.) Another feature and advantage of this design is reduced maintenance of the launching apparatus. There are fewer moving parts which have less mass and are activated with less force than a standard bolt-operated gun design; thus, there is less maintenance and replacement of parts.

e.) Because there is not bolt or hammer, there is less reciprocating mass which, in turn, creates less motion as the launching apparatus cycles. This results in improved accuracy of the launching apparatus.

f.) The design is efficient because all of the gas supplied into the system is used to propel the projectile.

g.) Consistency of the launching apparatus is improved by using an opposed piston regulator that vents overpressure.

A further advantage over prior art is the opposed-piston regulator design.

a.) Because the opposed piston regulator uses circumferential seals rather than face seals, there is less area to trap debris. Any debris which may enter the sealing area will simply be blown out in the next cycle.

b.) The opposed-piston regulator uses circumferential seals; thus, pressure is not applied to the seal in a way which would change the set operating point. The seal maintains its position, and the set point remains consistent.

c.) Unlike standard regulators, the opposed-piston regulator provides for an automatic venting mechanism for over pressure. If gas within the regulator expands or exceeds the set pressure for any reason, the pressure of the gas will continue to move the output piston to a point where the piston leaves its seal and vents overpressure until pressure normalizes and the piston returns to its seal, thus creating a failsafe mechanism.

d.) The opposed-piston design requires only one adjustment. Once the pressure within the regulator is set, any over-pressure within the regulator will automatically move the second piston and provide a venting mechanism without the need for a second adjustment.

These and other features and advantages of the invention will be more readily apparent upon reading the following description of a preferred embodiment of the invention and upon reference to the accompanying drawings.

Detailed Description of the Preferred Embodiment

FIG. 1 illustrates a projectile launching apparatus according to a preferred embodiment of the present invention which is compressed gas powered semi-automatic action apparatus capable of expelling projectiles of like size out of an attached barrel 102. The common use of this apparatus is as a marker or gun to propel gelatinous capsules known as paintballs; however, the projectiles should not be limited to this specific application. A projectile-storage chamber 101, such as a paintball loader, is preferably attached to a feed conduit 202. A compressed gas source 103 is preferably attached to a gas system adapter 235 by means of the threaded cavity 342 to provide a power source to operate the apparatus and propel the projectile.

A gas system adapter 235 attaches to the bottom of a grip frame 220 and directs inlet gas to flow from an external gas source 103 through a filter 233 located in the grip frame 220. A passage 330 extends past the filter 233 and directs the gas into a pressure regulator, which regulates the pressure by means of a spring and piston combination which has its operating pressure determined by the preset on the spring 723 created by pressure adjusting screw 231.

Figure 6A:
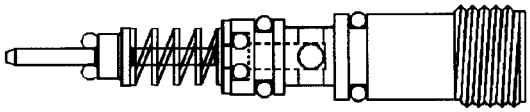
FIG. 6A illustrates the assembled transfer valve components in the open position.
Figure 6B:
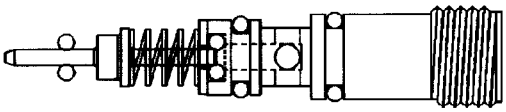
FIG. 6B illustrates the assembled transfer valve components in the closed position.

The regulated gas is the directed to a transfer valve assembly FIG. 6A, which controls the flow of gas to storage chamber 307.

Figure 7B:
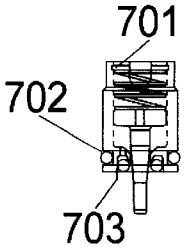
FIG. 7B illustrates the input assembly of the regulator in a detailed view.
Figure 7C:
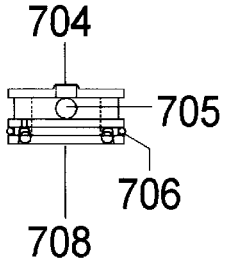
FIG. 7C illustrates the heart assembly of the regulator in a detailed view.
Figure 7D:
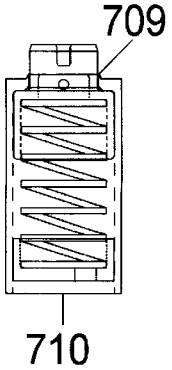
FIG. 7D illustrates the output assembly of the regulator in a detailed view.
Figure 7E:
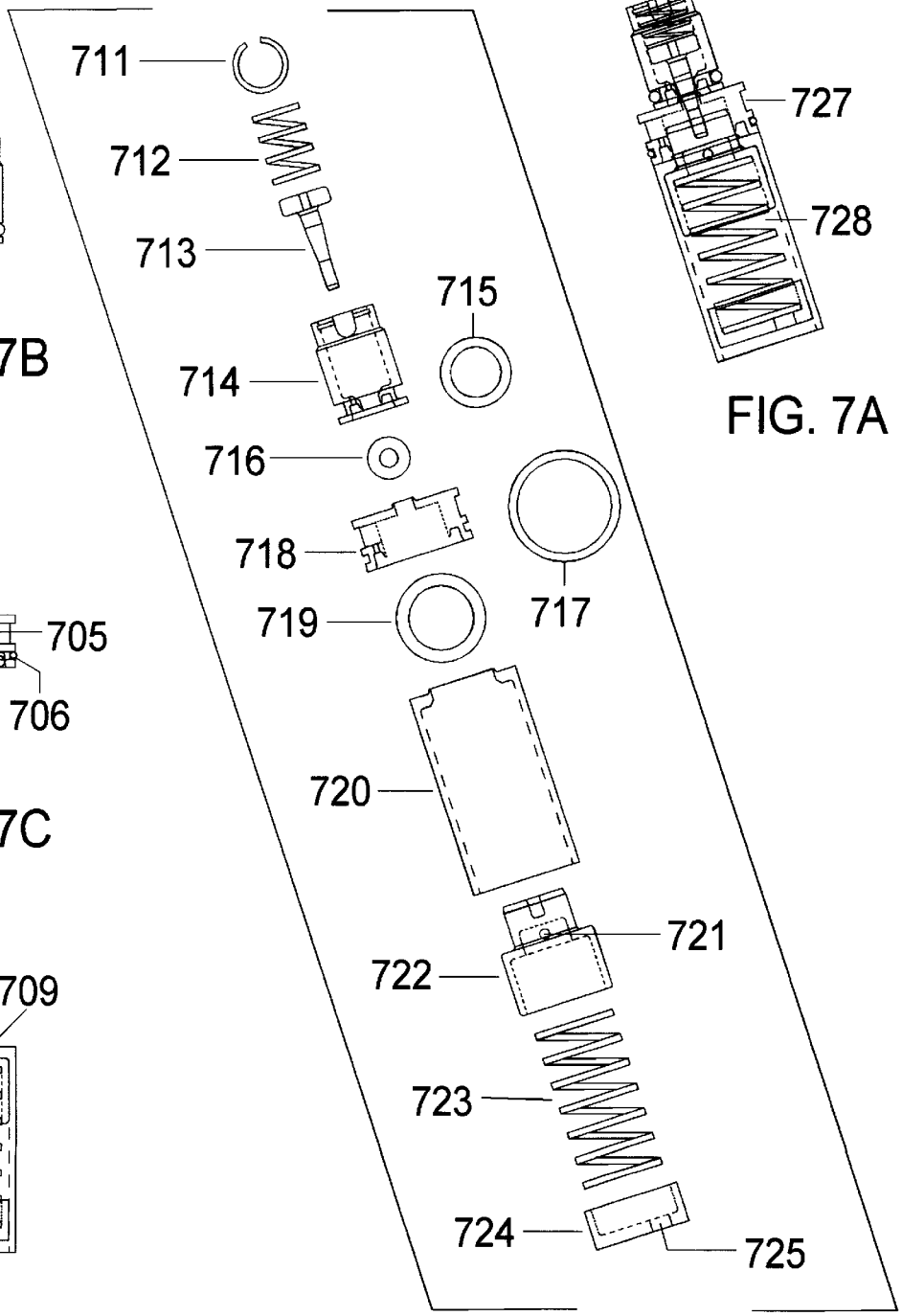
FIG. 7E illustrates the regulator components in an exploded view.
Figure 7A:
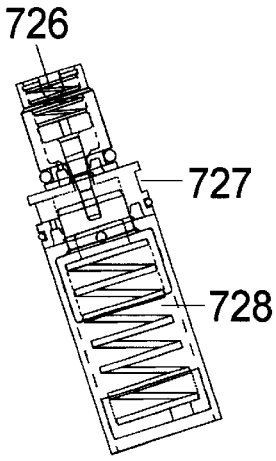
FIG. 7A illustrates the assembled regulator components.

The grip frame 220 houses a regulator assembly FIG. 7A. The regulator assembly as shown in FIG. 7A consists of a regulator-input assembly as shown in FIG. 7B, a regulator-heart assembly as shown in FIG. 7C, and a regulator-output assembly as shown in FIG. 7D. An exploded view of the entire regulator FIG. 7A is shown in FIG. 7E.

Regulator-input Assembly as Shown in FIG. 7B

A regulator-input assembly as shown in FIG. 7B is located in cavity 328 of the grip frame 220. FIG. 7B includes of a regulator-input housing 714 with a passage from the input to the output. The output passage is a gland 703, with radial flow passages, which supports a regulator-input seal 716. An input shaft 713 sits within housing 714 axially concentric and extending through seal 716. A return spring 712 sits atop input shaft 713, and a retaining clip 711 sits atop return spring 712 in a groove 701. A seal 715 is located in a groove 702 on the outside of the housing 714.

Regulator-heart Assembly as Shown in FIG. 7C

The regulator-heart assembly as shown in FIG. 7C is located in a cavity 329 of grip frame 220. FIG. 7C includes of a regulator-heart housing 718 which contains concentric input passage 704, output passage 708, and radial passages 705. Passages 705 run from the regulated pressure chamber 727 of the regulator heart 718. Input passage 704 is a gland that supports input seal 716. Output passage 708 is a gland that supports regulator-output seal 719. Regulator-input shaft 713 extends through input passage 704. A seal 717 is located in a groove 706 on the outside of housing 718.

Regulator-output Assembly as Shown in FIG. 7D

The regulator-output assembly FIG. 7D is located in cavity 329 of grip frame 220. FIG. 7D includes a regulator-output housing 720 which contains concentric input passage 709 and output passage 710. Input passage 709 is a gland with radial flow passages that support regulator-output seal 719. Regulator-output housing 720 contains the output shaft 722, which has radial flow passages 721. Output shaft 722 extends through output seal 719 and joins axially to input shaft 713. Main-spring cap 724 sits on the opposite side of and partially contains a main spring 723. The main spring 723 sits partially within output shaft 722. A main-spring cap 724 contains a passage 725. Main-spring cap 724 fits into regulator-output housing 720.

Transfer-valve Assembly as Shown in FIG. 6A

Figure 6C:
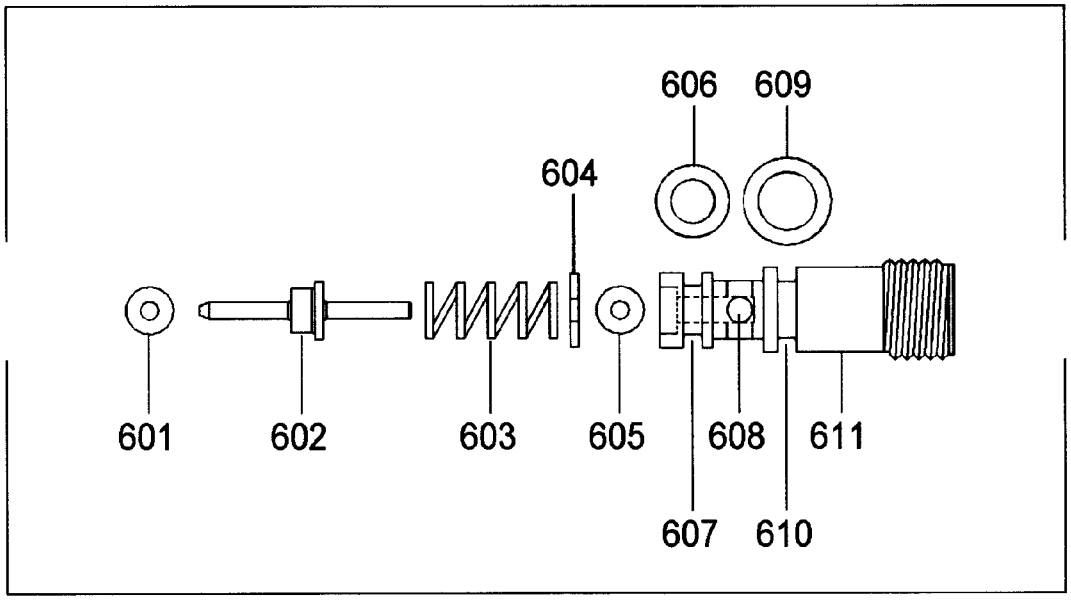
FIG. 6C illustrates the transfer valve components in an exploded view.

A transfer valve assembly as shown in FIG. 6A is located in a cavity 326 of grip frame 220. FIG. 6C is an exploded view of the components of FIG. 6A. A seal 601 is located at the bottom of cavity 326. The front of a shaft 602 extends through seal 601 and rests against a metal slide 808 in cavity 322. A spring 603 acts against the shaft 602. The opposite side of spring 603 is seated against a plate 604. Plate 604 retains a seal 605 in transfer valve plug 611. A seal 605 is inset into the end of transfer valve plug 611. A passage extends through seal 605 and connects to radial passages 608 located in transfer valve plug 611. Seal 606 is located in groove 607 on the outside of transfer valve plug 611. Seal 609 is located in groove 610 on the outside of transfer valve plug 611.

Figure 4A:
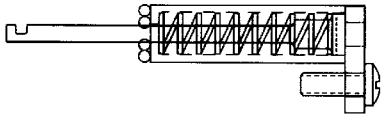
FIG. 4A illustrates the assembled partition activation components in the discharged position.

Partition-Activation Assembly as Shown in FIG. 4A

Figure 4B:
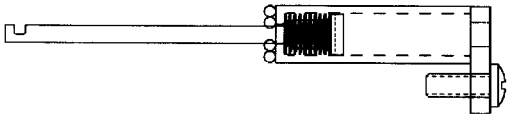
FIG. 4B illustrates the assembled partition activation components in the charged position.
Figure 4C:
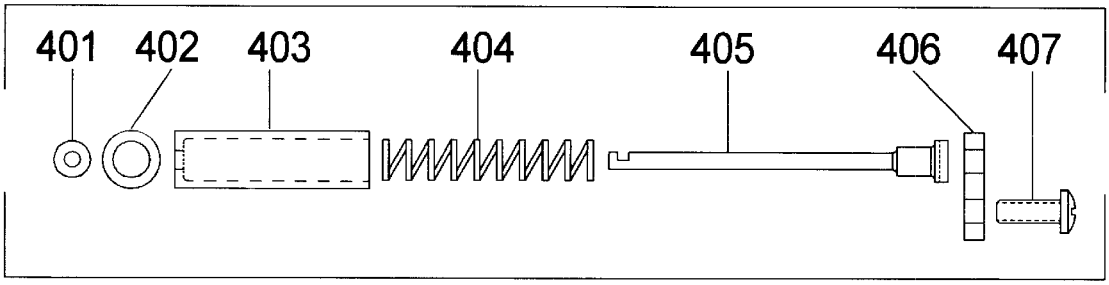
FIG. 4C illustrates the partition activation components in an exploded view.

The partition-activation assembly as shown in FIG. 4A is located in a cavity 306 in the main body 207. FIG. 4A illustrates components in the discharged position, and FIG. 4B illustrates components in the charged position. FIG. 4C is an exploded view of the components of FIG. 4A. At the bottom of the cavity 306, a seal 401 sits concentrically within the seal 402. A tube 403 is located in cavity 306 and retains the seal 401 and seal 402 in position. A spring 404 is located within tube 403. A rod 405 sits concentrically within spring 404. The notched end of rod 405 extends through the end of tube 403, through seal 401, and into a cavity 343. Plate 406 sits within cavity 313 and retains tube 403 and assembled components contained within cavity 306. Plate 406 is retained with screw 407 which threads into hole 312.

Partition 203 is located in cavity 343. Partition 203 attaches to rod 405 by means of a tab which hooks onto the notched end of rod 405. Rod 405 extends into cavity 343 from the cavity 306.

Figure 5A:
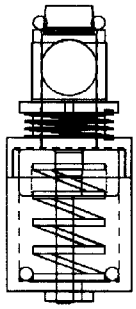
FIG. 5A illustrates the assembled exhaust valve components in the charged position.

The Exhaust-valve Assembly as Shown in FIG. 5A

Figure 5B:
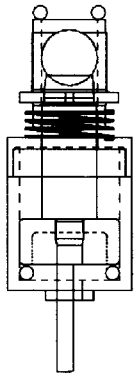
FIG. 5B illustrates the assembled exhaust valve components in the exhaust position.
Figure 5C:
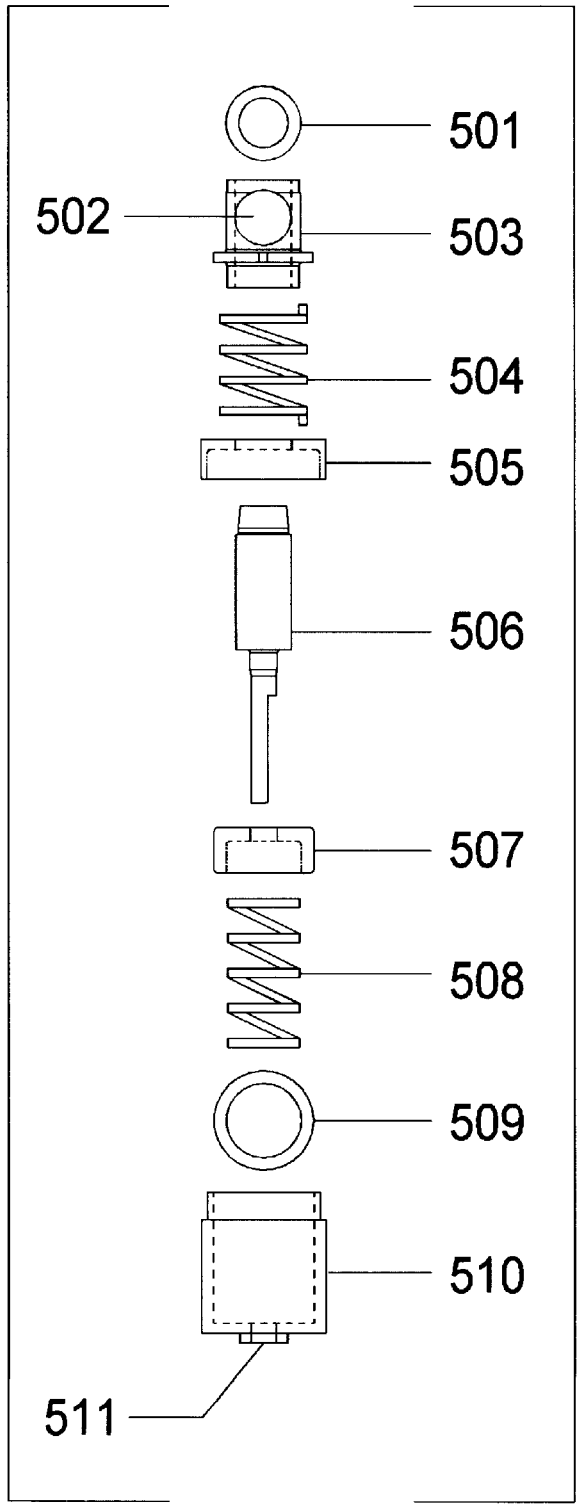
FIG. 5C illustrates the exhaust valve components in an exploded view.

The exhaust-valve assembly as shown in FIG. 5A is located above metal slide 808 between the main body 207 and the grip frame 220 with the lower portion in cavity 317 and the upper portion in cavity 310. FIG. 5A illustrates regulator assembly in the charged position. FIG. 5B illustrates the regulator assembly in the discharged position. FIG. 5C is an exploded view of the components of FIG. 5A. A bumper 509 sits within an exhaust-valve body 510. A spring 508 sits concentrically within the bumper 509. An exhaust-piston cup 507 attached to an exhaust piston 506 contains spring 508 and sits concentrically within exhaust-valve body 510. The bottom of exhaust piston 506 aligns with a passage 511 located in the bottom of exhaust-valve body 510. An exhaust-valve cap 505 is attached to exhaust-valve body 510 and contains components 506, 507, 508, and 509. The top of exhaust piston 506 extends through exhaust-valve cap 505. A spring 504 with an alignment tab on each end indexes atop cap 505, concentric with the exhaust piston 506. A jet 503 sits atop spring 504 and is indexed by means of a tab on spring 504. Exhaust piston 506 extends through jet 503 and into a seal 501. Seal 501 sits atop jet 503 in cavity 310 in main body 207. Passage 502 in jet 503 directs the exhaust gas to passage 305 in main body 207.

Figure 8A:
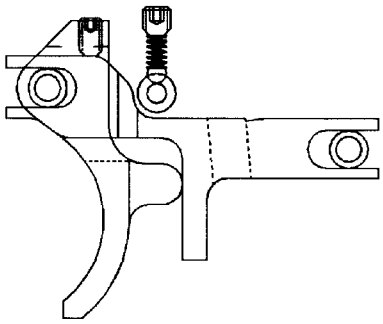
FIG. 8A illustrates the assembled safety and actuator components.

Actuator as Shown in FIG. 8A

Figure 8B:
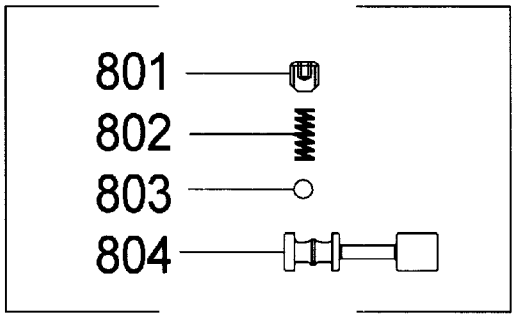
FIG. 8B illustrates the safety assembly parts in an exploded view.
Figure 8C:
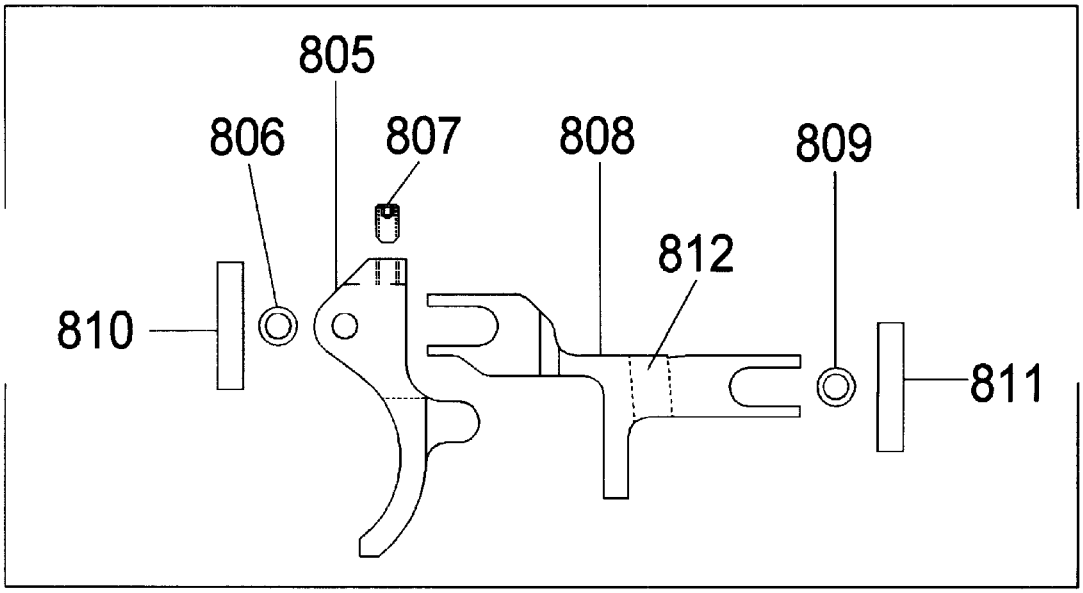
FIG. 8C illustrates the actuator assembly parts in an exploded view.
Figure 9A:
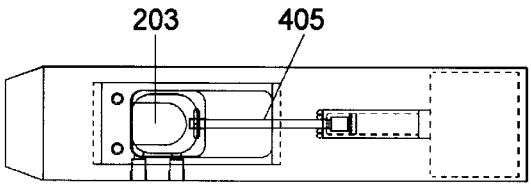
FIG. 9A illustrates the partition and activating means in a charged position from a top view.
Figure 9B:
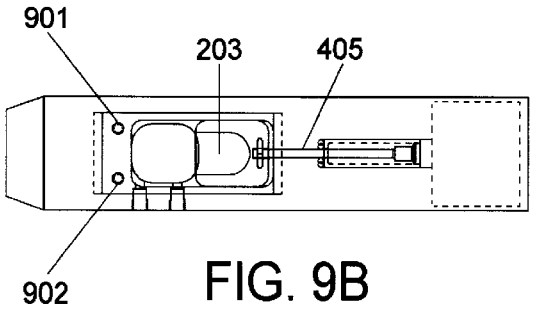
FIG. 9B illustrates the partition and activating means in a discharged position and feed conduit attaching holes.
Figure 9C:
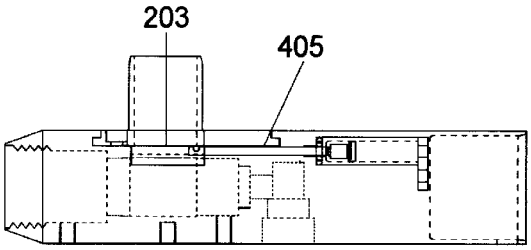
FIG. 9C illustrates the partition and activating means in a charged position from a side view.
Figure 9D:
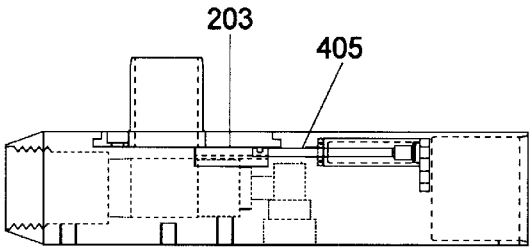
FIG. 9D illustrates the partition and activating means in a discharged position from a side view.

An actuator assembly as shown in FIG. 8A is located in cavity 322 of grip frame 220. FIG. 8C is an exploded view of the actuator components. FIG. 8B is an exploded view of the safety components. A pivoting lever 805 is located in front of a metal slide 808. An actuator-movement-limiting screw 807 is located in the top of pivoting lever 805. The pivoting lever 805 is attached to grip frame 220 in cavity 322 by means of a pin 810, located in a hole 315. Pin 810 also retains bearing 806 and supports the front of metal slide 808. A pin 811, located in a hole 318 of grip frame 220, retains bearing 809 and supports the rear of metal slide 808.

A safety assembly FIG. 8B is located behind the front portion of the metal slide 808. The shaft 804 is contained in a hole 316 in grip frame 220. A ball 803 located in a hole 346 sits in one of two grooves in the safety shaft 804. A spring 802 is located atop ball 803 and is retained by a safety screw 801.

An actuator-stop screw 225 is located in a threaded hole 323 in grip frame 220.

Figure 3A:
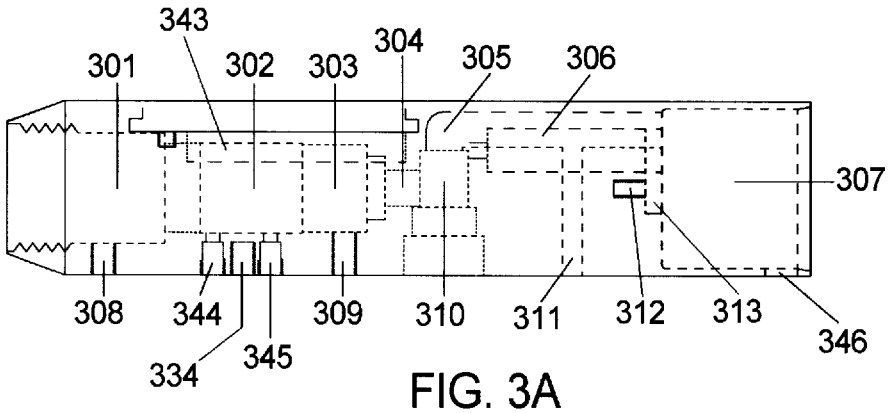
FIG. 3A illustrates passages and cavities within the main body of the pneumatic launching apparatus.
Figure 3B:
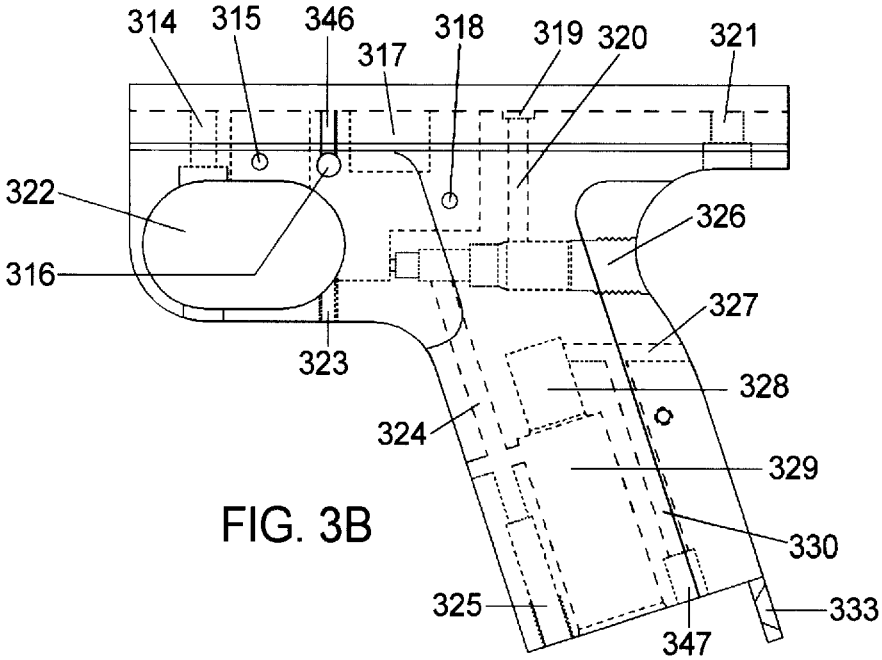
FIG. 3B illustrates passages and cavities within the grip frame of the pneumatic launching apparatus.
Figure 3C:
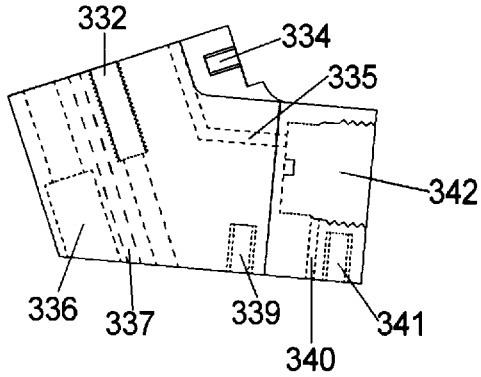
FIG. 3C illustrates passages and cavities within the gas system adaptor.

Gas-source Adapter as Shown in FIG. 3C

The gas source adaptor 235 as shown in FIG. 3C illustrates passages, cavities, and holes. The gas source adaptor 235 attaches to the bottom of grip frame 220 by means of screw 229 and screw 236. Screw 229 extends through hole 333 of grip frame 220 and attaches at hole 334. Screw 236 extends through hole 336 and attaches at hole 325 of grip frame 220. One end of the gas-source adapter 235 has a threaded cavity 342. A passage 335 extends from the threaded cavity 342 to the top of the gas-source adapter 235. A screw 231 threads into cavity 332 in gas-source adapter 235. A passage 337 runs from the top to the bottom of gas-source adapter 235. Two accessory-attaching holes 339 and 341 are located in the bottom of the gas-source adapter 235. Vent hole 340 runs from threaded cavity 342 to the outside of gas-source adapter 235. Variations in the form of the adapter can be made to accommodate different connection fittings. Different manufacturers' gas sources and related fittings dictate an associated complementary gas source adapter.

Grip Frame as Shown in FIG. 3B

FIG. 3C illustrates passages, cavities, and holes. Grip frame 220 has a cavity 347 which contains a seal 234 that retains a filter 233. A seal 232 is located on the opposite side of a filter 233. A passage 330 leads from the cavity 347 to passage 327 to cavity 328. Cavity 328 contains a regulator input housing assembly FIG. 7B. Cavity 329 attaches to a cavity 328. The cavity 329 contains a regulator heart assembly FIG. 7C and a regulator output assembly FIG. 7D. A passage 324 leads to a cavity 326 that contains a transfer valve assembly FIG. 6A. A passage 320 leads from the cavity 326 to the top of the grip frame 220. At the top of the grip frame 220 is a cavity 319, which retains a seal 219. The cavity 317 retains the bottom portion of an exhaust-valve assembly FIG. 5A.

A screw 224 extends through hole 314 in grip frame 220 and into threaded hole 334 of main body 207. A screw 226 extends through hole 321 in grip frame 220 through hole 346 in the main body 207 and into hole 211 in rear cap 210.

Main Body as Shown in FIG. 3A

FIG. 3A illustrates passages, cavities and holes within a main body 207. The cavity 307 is attached to cavity 313 which contains partition retaining plate 406. The cavity 307 attaches to a cavity 306 which partition-activation assembly FIG. 4A. The cavity 307 attaches to passage 305. Passage 305 intersects with a passage 311 and leads to cavity 310. The passage 311 leads to the bottom of the main body 207 and aligns with passage 320 in grip frame 220. The cavity 310 contains the top portion of an exhaust-valve assembly FIG. 5A. A passage 304 extends from the cavity 310 to a cavity 302 through a diffuser 237 contained in cavity 303. A screw 216 in a hole 309 retains the diffuser 237. The cavity 301 is threaded to allow a barrel 102 to attach coaxially. A first ball positioner 217 extends into the cavity 302 through a hole 345. A screw 218 retains Ball positioner 217. A second ball positioner 212 extends into the cavity 302 through a hole 344. A spring 213 is located below the ball positioner 212 and is retained by a screw 214.

Figure 2:
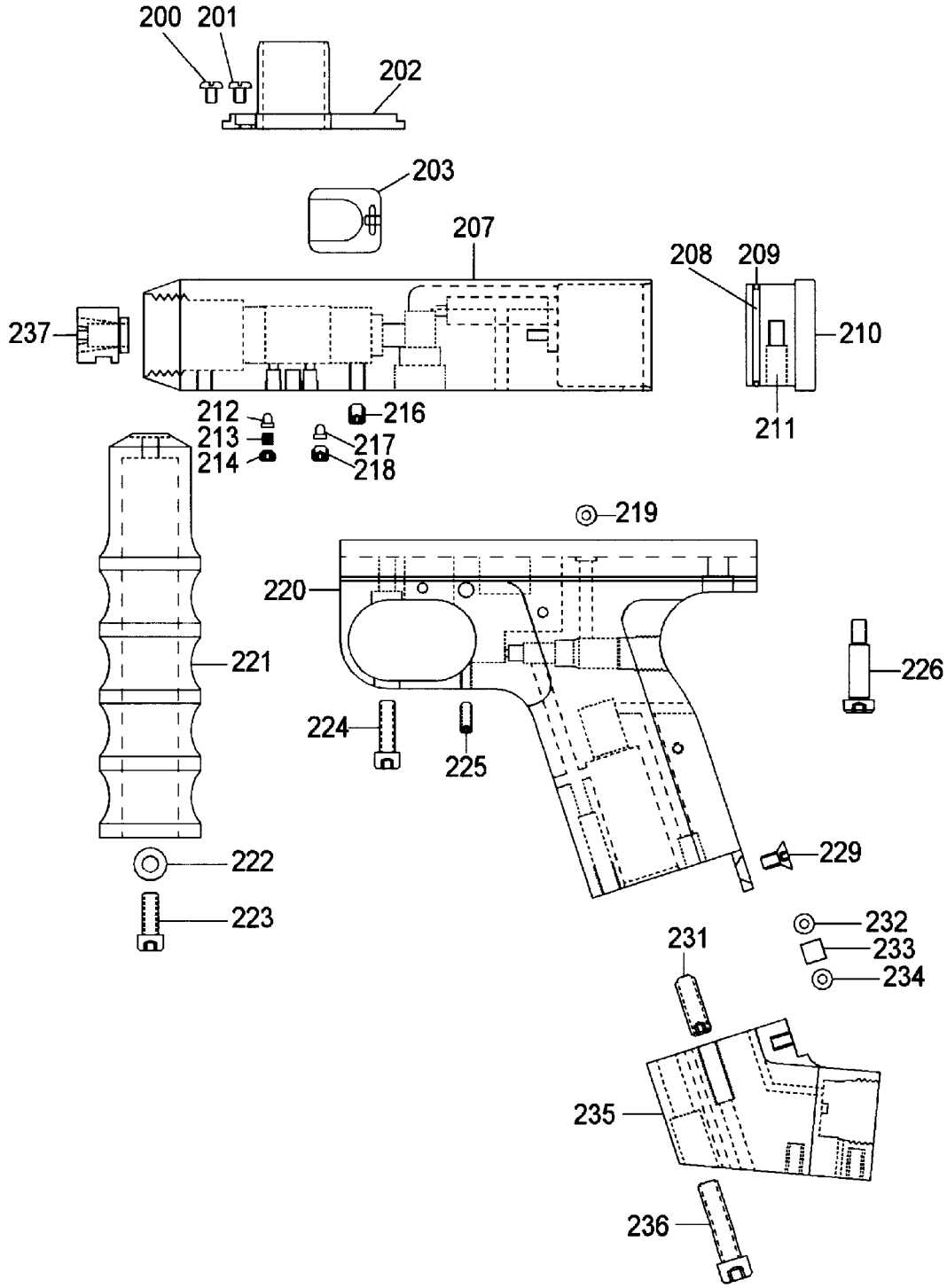
FIG. 2 illustrates external components of the pneumatic launching apparatus.

Rear Cap as Shown in FIG. 2

Seal 209 is located in groove 208 of rear cap 210. The rear cap 210 extends into a cavity 307 of the main body 207.

Fore Grip as Shown in FIG. 2

The fore grip 221 attaches to main body 207 by means of washer 222 and screw 223 threaded into hole 308.

Loader Plate as Shown in FIG. 2

The loader plate 202 attaches to main body 207 by means of screw 200 which threads into hole 901 and screw 201 which threads into hole 902.

Description of the Operation of the Invention

Operation of Regulator

A high-pressure gas source 103 is attached to air system adapter 235. The high-pressure gas 726 flows through a passage 335 to a filter 233 in cavity 347 which limits debris from entering the system.

The high-pressure gas flows to the regulator input assembly FIG. 7B. The gas flows past piston 713 and through the input seal 716 to a chamber 727 which contains the regulator output piston 722. As pressure increases, the output piston 722 moves against the regulator main spring 723. The regulator-input piston 713, which is returned by a spring 712, tracks with the output piston 722 to the point where the input piston 713 enters the input seal 716. This action creates a regulated gas pressure chamber determined by the preset on the main spring 723 which is set by the adjuster screw 231 in the air system adapter 235.

Input piston 713, once in the seal 716, rests on a mechanical stop to restrict further movement. The output piston 722 is capable of continued movement on its own against the main spring 723. If there is an increase in pressure in the regulated gas pressure chamber, the output piston 722 will continue to compress the main spring 723 and move out of its seal 719 venting the over-pressure externally through a passage 337 in the air system adapter 235. When pressure drops sufficiently to allow the output piston 722 to re-enter its seal 719, the chamber will maintain regulated pressure.

Operation of the Transfer Valve

The regulated gas in chamber 727 then flows to the transfer valve FIG. 6A. In the open position, the transfer valve piston 602 is held forward by a spring 603 and gas pressure on seal 601 which seals the forward most portion of the piston 602. While the transfer-valve piston 602 remains in the open position, it allows gas to pass through the seal 605 to the radial passages 608 in the transfer valve plug 611.

When the transfer valve piston 602 is moved rearward, it enters a seal 605 which is contained in the end of the transfer valve plug 611. This action effectively seals off the regulated gas pressure from passing through the seal 605.

Operation of Actuator

The pivoting lever 805 is used to provide mechanical advantage against the slide 808 to create movement in it and transfer valve piston 602. The metal slide 808 also contains a cavity 812 in which the bottom portion of exhaust-valve piston 506 can enter and move to its exhaust position.

Operation of the Movable Partition

The partition rod assembly FIG. 4A is sealed within the cavity 306 by a seal stack consisting of a first seal 401 within a second seal 402. A plate 406 and a screw 407 contain the assembly, including the tube 403, spring 404, rod 405, and seals 401 and 402. The partition 203 is contained in cavity 343 by the loader plate 202. Partition 203 is attached to rod 405 by means of a tab in partition 203 and a notch in the partition rod 405. Regulated gas acts against partition rod 405 and moves it to the charged position where its movement is limited by partition 203's closing against a stop. While gas pressure is present, partition rod 405 is held in the charged position against the compressed spring 404. While not under pressure, partition rod 405 is held in the discharged position by spring 404. As movable partition 203 slides into the forward position, it slides between two adjacent projectiles, separating them and lifting the second projectile slightly and seals the firing chamber 302. Alternate embodiments incorporate an electronic movement means or a magnetic movement means rather than a pneumatic movement means to move the partition apparatus. A magnetic or electromagnetic means may also be incorporated to retract the actuating rod to a second position and effectively latch it in that position until pneumatic action overcomes the latching force.

Operation of the Exhaust Valve

Figure 11:
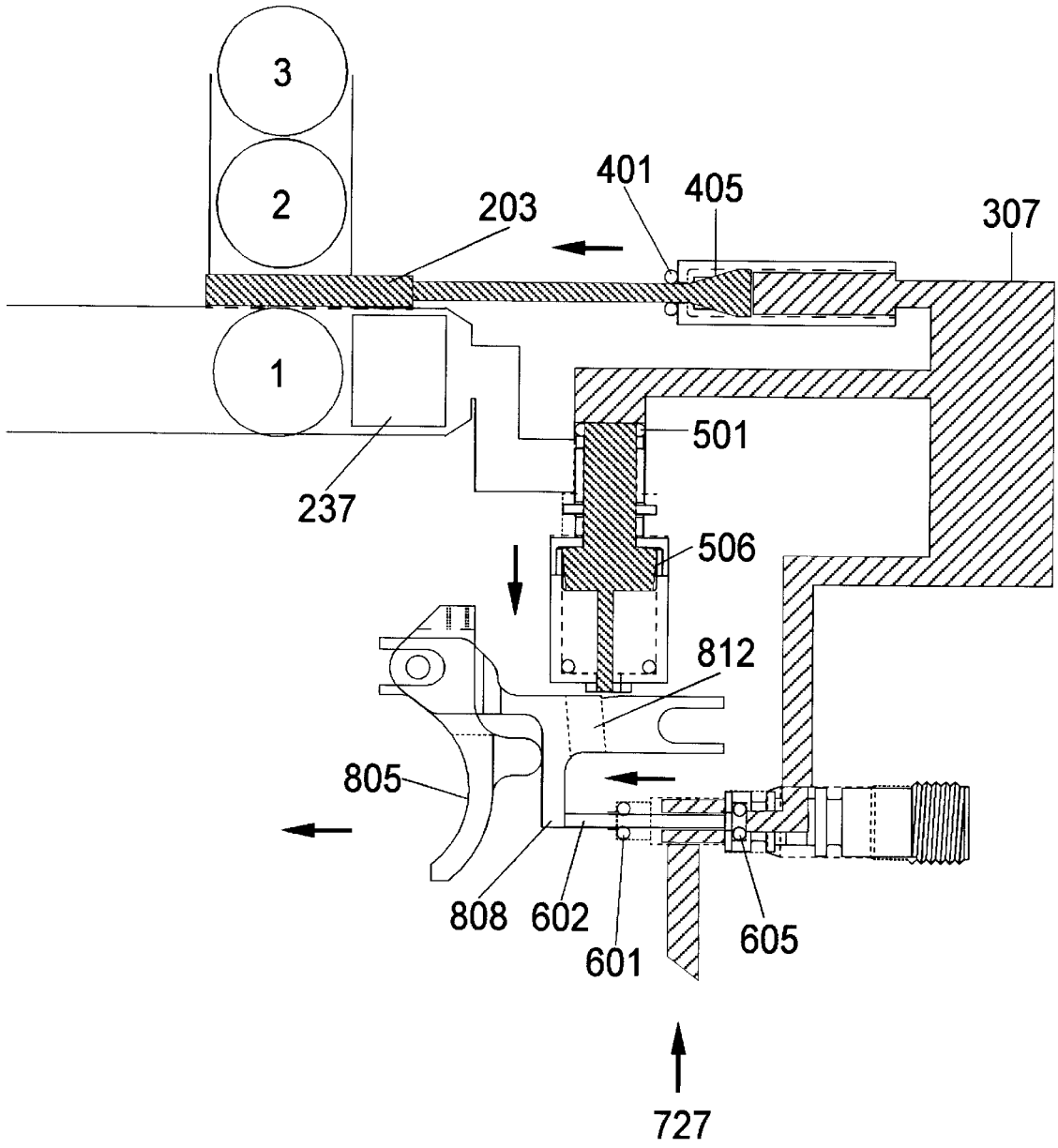
FIG. 11 illustrates flow of regulated gas in the pneumatic launching device and relative position of affected components, actuator released, assembly charged.
Figure 12:
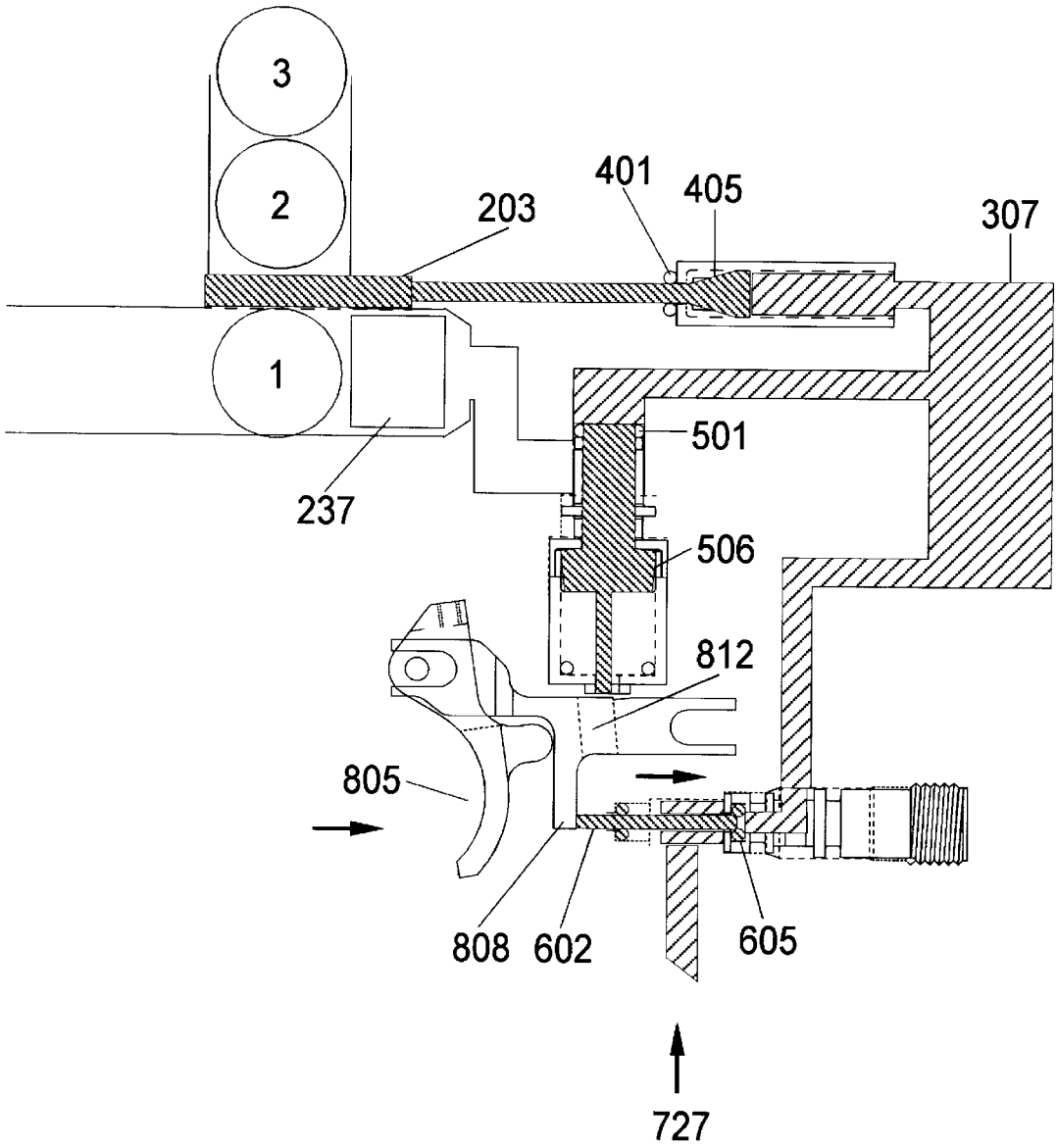
FIG. 12 illustrates gas in the storage chamber being isolated as the actuator is partially pulled and the transfer valve rod enters its seal.

The exhaust-valve assembly FIG. 5A is contained within grip frame cavity 317 and supports the exhaust jet 503 and seal 501. A seal 501 with concentric exhaust piston 506 seals gas from escaping from storage chamber 307, FIG. 12. Charged, with metal slide 808 in the forward position, the exhaust value piston 506 rests on the metal slide 808 as seen in FIG. 11. Gas pressure moves the seal 501 and exhaust jet 503 to the charged position. The regulated gas guides the seal 501 over the exhaust piston 506 and it seals both internally on piston 506 and externally in cavity 301. The exhaust jet 503, which rests atop the exhaust valve body cap 505, maintains the seal's position.

Figure 13:
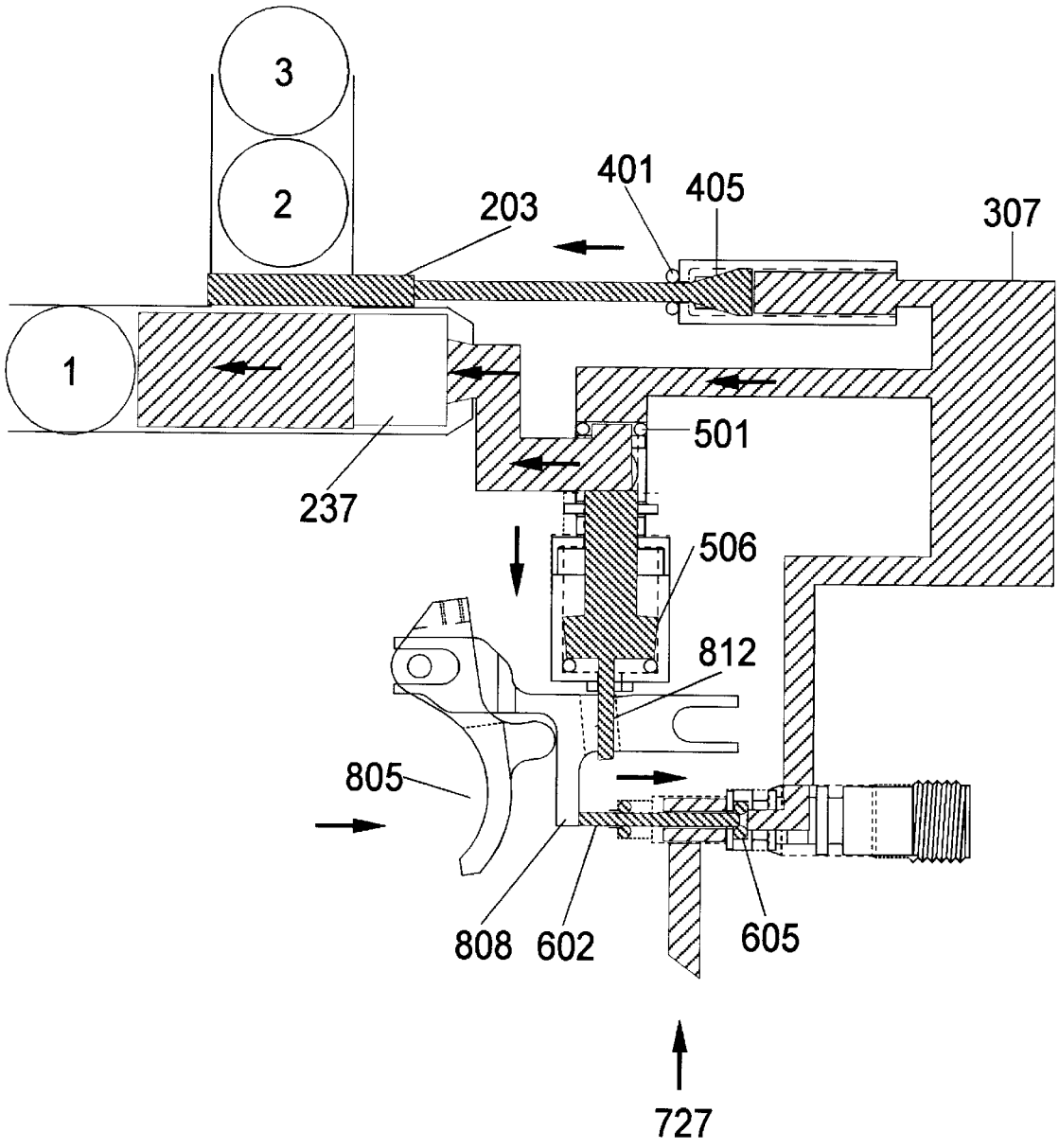
FIG. 13 illustrates the gas in the storage chamber being exhausted and propelling the projectile as the actuator is fully pulled.
Figure 14:
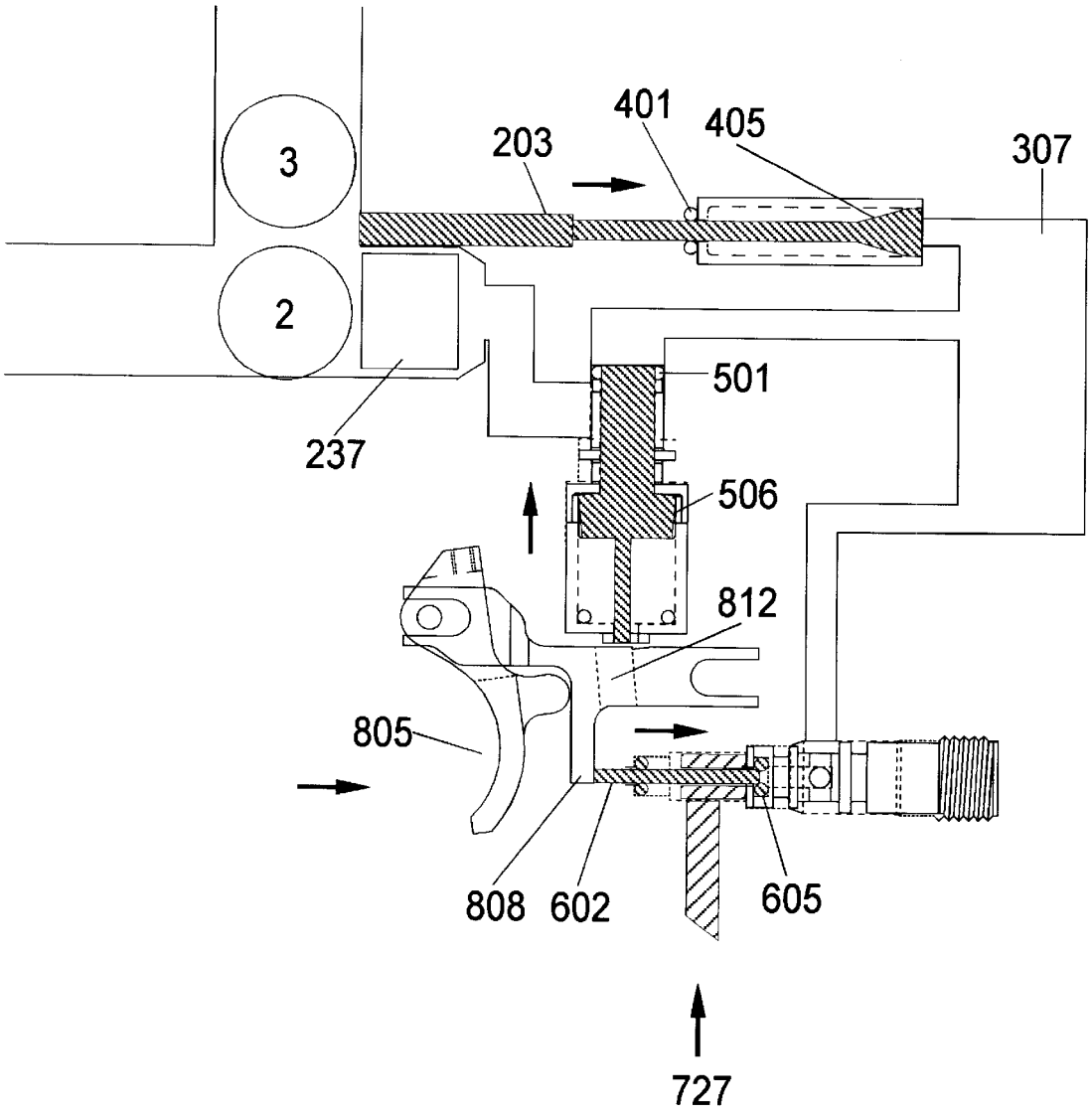
FIG. 14 illustrates the relative position of affected components after exhaust of gas from the storage chamber as the actuator is fully pulled.
Figure 15A:
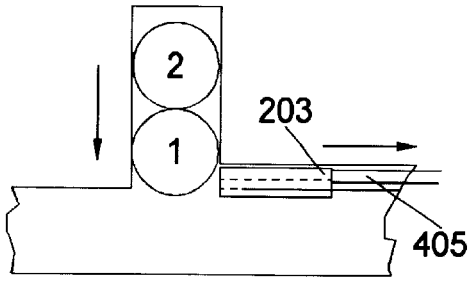
FIGS. 15A, C, E, and G are shown in side views illustrating the sequence of a projectile entering the firing chamber as the partition transitions from open to closed and separates the projectile in the firing chamber from the others in the feed conduit.
Figure 15B:
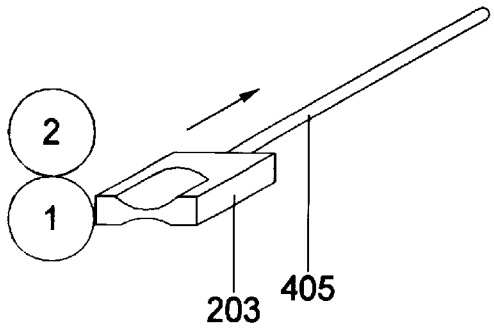
FIGS. 15 B, D, F, and H are shown in orthogonal views illustrating the sequence of a projectile entering the firing chamber as the partition transitions from open to closed and separates the projectile in the firing chamber from the others in the feed conduit.
Figure 15C:
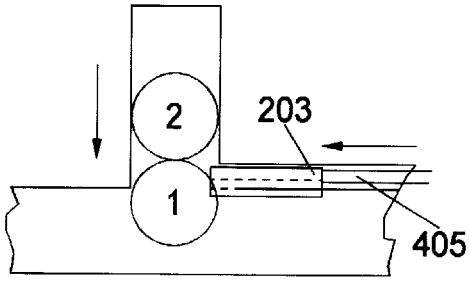
Figure 15D:
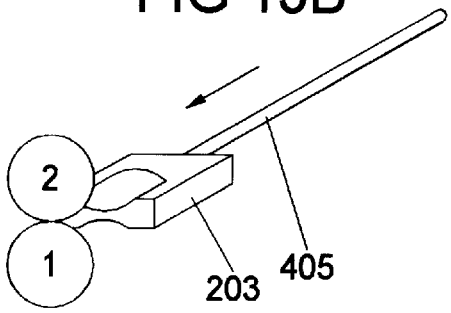
Figure 15E:
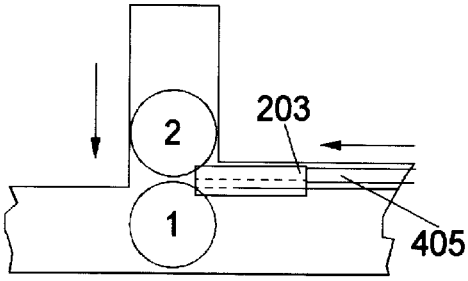
Figure 15F:
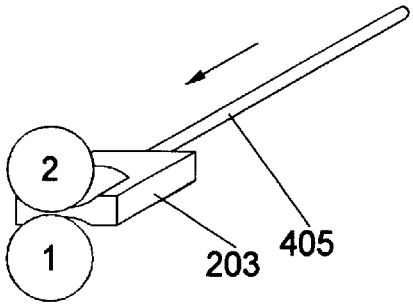
Figure 15G:
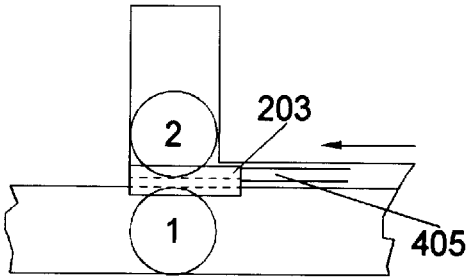
Figure 15H:
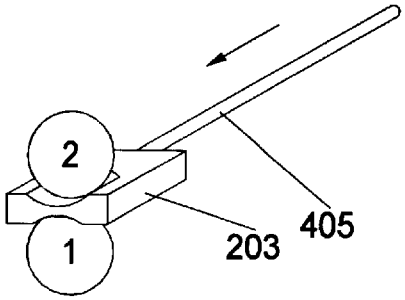
Figure 16A:
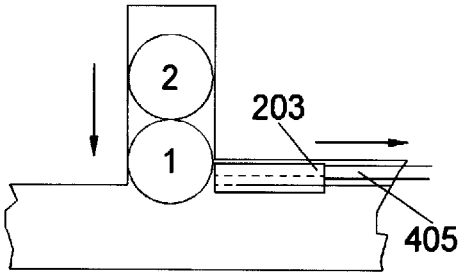
FIGS. 16A, C, E, and G are shown in side views illustrating the sequence of a projectile that has not fully entered the firing chamber as it is cradled and lifted back into the feed conduit and as the partition transitions from open to closed isolating the projectiles in the feed conduit from the firing chamber.
Figure 16B:
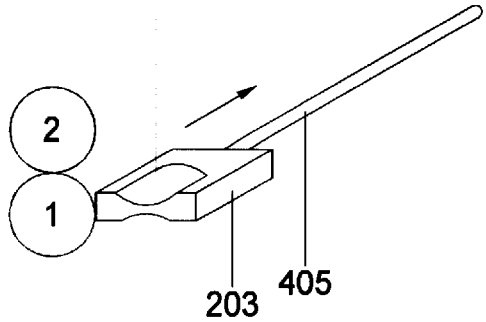
FIGS. 16 B, D, F, and H are shown in orthogonal views illustrating the sequence of a projectile that has not fully entered the firing chamber as it is cradled and lifted back into the feed conduit and as the partition transitions from open to closed isolating the projectiles in the feed conduit from the firing chamber.
Figure 16C:
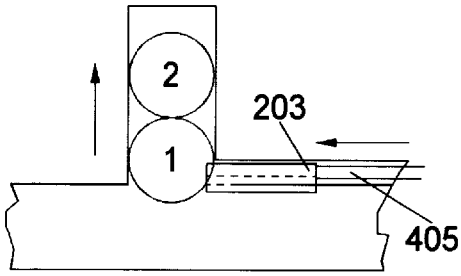
Figure 16D:
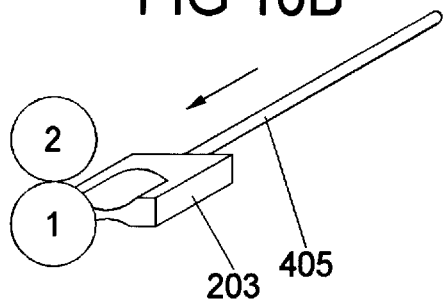
Figure 16E:
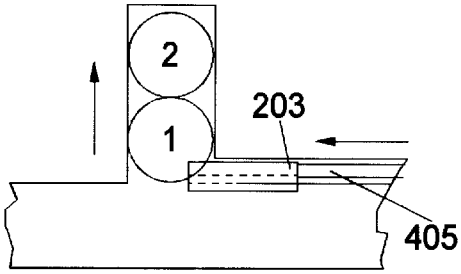
Figure 16F:
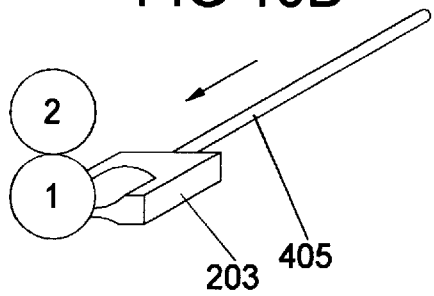
Figure 16G:
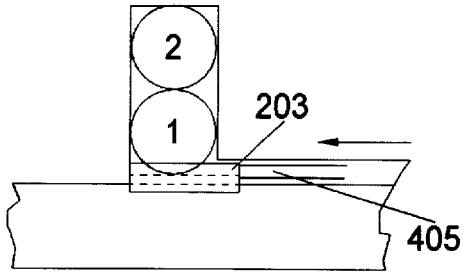
Figure 16H:
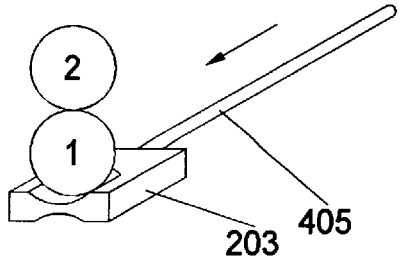

When the metal slide 808 is moved rearward, a cavity 812 is exposed below the exhaust piston 506, as seen in FIG. 13. The exhaust piston 506 is opened by the gas in 307, exiting through passage 502 in jet 503. As the gas pressure in cavity 307 dissipates, the exhaust jet 503 is moved to its exhaust position by a spring 504, which in turn moves the seal 501 to its upper-most position, as seen in FIG. 14. Once the gas pressure is exhausted, the exhaust piston 506 returns to its up position by means of the exhaust valve spring 508. The assemblies will maintain this up position until chamber 307 is charged.

Description of Operation—One Semi-automatic Cycle

Figure 10A:
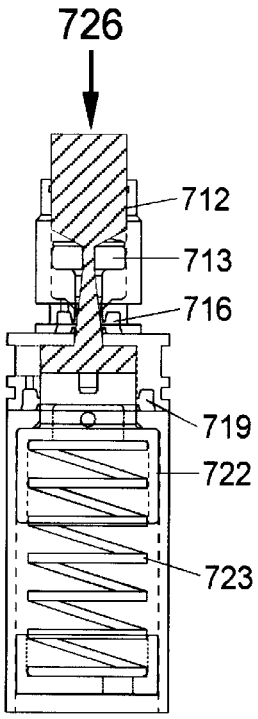
FIG. 10A illustrates gas flow into the regulator past the input piston and the regulated pressure chamber.
Figure 10B:
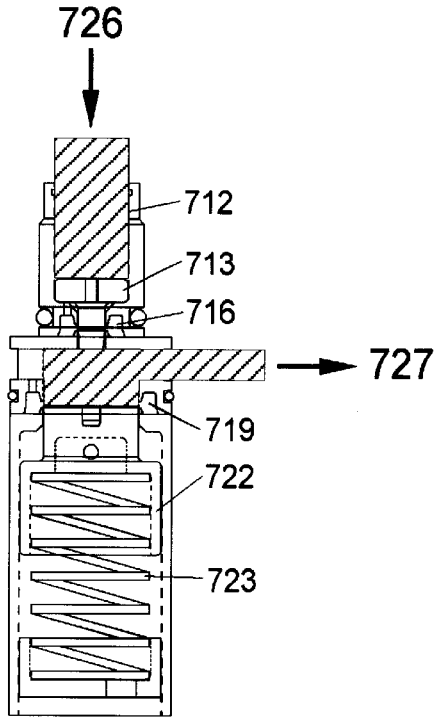
FIG. 10B illustrates the unregulated inlet gas being sealed from entering the regulated pressure chamber.
Figure 10C:
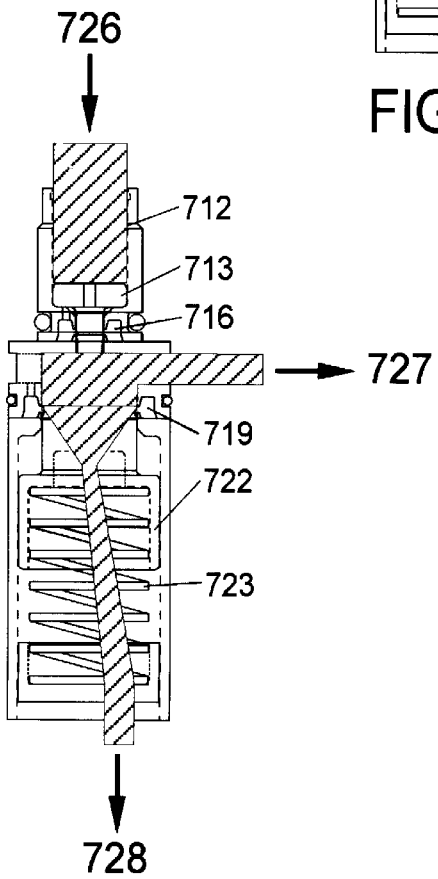
FIG. 10C illustrates gas in the regulated pressure chamber venting excess pressure from the regulated pressure chamber.

The preferred embodiment of one semi-automatic cycle involves supplying compressed gas to the regulator where the output piston 722, under pressure, moves against the main spring 723, as seen in FIG. 10A. The output piston 722 continues its movement until the input piston 713 enters its seal 716 effectively sealing off any further gas from entering the chamber 727, as seen in FIG. 10B. The regulated gas flows through seal 605 of the transfer valve then to storage chamber 307, as seen in FIG. 11. The regulated gas acts to move the partition rod 405 and partition 203 to the closed or charged position. The regulated gas also acts to seal the exhaust-valve seal 501 against exhaust-valve piston 506.

When the pivoting lever 805 is engaged, it in turn moves slide 808 against the transfer valve piston 602, which moves into its seal 605, as seen in FIG. 12A. This action separates the regulated pressure in the regulated pressure chamber from the pressure in the storage chamber 307. The lever 805, slide 808, and transfer valve piston 602 continue to move rearward to the point where cavity 812 is exposed to the exhaust-valve piston 506, as seen in FIG. 13A. The piston 506 is then able to move to its exhaust position and expel the gas held in the storage chamber 307 through a gas diffuser 237. The gas diffuser 237 controls the gas flow before reaching the projectile. The force of the gas causes the projectile to be ejected from the firing chamber, as seen in FIG. 14A. The pressure exhausted, the exhaust-valve piston 506 returns to the set position. When pivoting lever 805 is disengaged, it allows metal slide 808 to move forward which, in turn, moves cavity 812 from under the exhaust-valve piston 506 and blocks it from moving. This action also allow transfer-valve piston 602 to move out of seal 605 in reaction to force supplied by spring 603, which, in turn, allows gas to flow to the storage chamber 307.

As the regulated gas flows to the storage chamber 307, the pressure in the regulated-pressure chamber 727 decreases. The decrease in pressure causes output shaft 722 to be moved by the compressed spring 723, which in turn moves the input shaft 713 out of its seal 716 allowing the compressed gas to flow into the regulator, as seen in FIG. 10A. This action completes one semi-automatic activation and prepares it for the next cycle.

ALTERNATIVE EMBODIMENTS

Modifications and variations of the present invention are possible in light of the above description. Alternate embodiments may include the following:

- The metal slide can become the actuator itself in which a pivoting lever is not used for mechanical advantage.
- Magnetic movement can be used in the regulator, actuator, and/or partition instead of a spring's mechanical movement.
- Electronic, electro mechanical, electro magnetic actuation can be used in the regulator, actuator, and/or partition instead of mechanical activation.
- The movable partition apparatus may have a lever or pin, which helps the projectile load into the firing chamber.
- Different forms of diffusers or control orifices, such as multiple holes of various sizes and placement can be used to control the exhaust gas and/or pressure wave that is applied to the projectile.
- A secondary valve can be incorporated behind the projectile possibly into the air diffuser to pneumatically or mechanically help accelerate the projectile from rest during the first part of the exhaust cycle.
- Transfer-valve seals and pistons can be altered in size to change the balance of pressure on the actuator mechanism thereby altering the performance of the actuator pull and return.
- The exhaust seal and piston can be altered in size to change performance of the exhaust-valve system.
- Other ball retaining devices such as formed springs or spring-loaded ramps can be incorporated in place of the ball stops.
- Electronic, magnetic, mechanical, or pneumatic devices may be incorporated as part of the actuating mechanism to enhance performance. This may be done to either lighten the activating force necessary to cycle the apparatus, make it cycle faster (more rapidly), or be used in a fully automatic mode where one cycle of actuator pull will result in multiple cycles of exhaust and recharge of the launching apparatus.

Although the above contains many specificities, these should not be construed as limiting the scope of the invention but as merely providing illustrations of some of the alternate embodiments of this invention. For example, the movable partition can have other shapes, such as circular, oval, trapezoidal, triangular, etc., based on the projectile it must accommodate; the compressed gas source could be generated or contained in a variety of ways; and the mechanical movement of the springs in the regulator, actuator or partition can be duplicated with magnetism.

Thus, the scope of the invention should be determined by the claims and their legal equivalents, rather than by the examples given.

What is claimed is:

1. A bolt-less paintball gun for launching projectiles, comprising:

a projectile feed conduit having a plurality of projectiles;

a firing chamber for retaining at least a first projectile;

a movable partitioning means interposed between the firing chamber and the projectile feed conduit, characterized in that in a first position, an aperture is exposed, such that a first projectile passes from the feed conduit into the firing chamber; and in a second position, the aperture is covered and the first projectile located in the firing chamber is separated from a second projectile located in the projectile feed conduit, and the firing chamber is pneumatically sealed by the movable partitioning means;

an actuation means for alternately moving the movable partitioning means between the first and second position.

2. The apparatus according to claim 1, wherein the partitioning means comprises a generally flat element.

3. The paintball gun according to claim 1, wherein the partitioning means has a top, a bottom, a front edge and a rear edge, wherein a height of at least a portion of the front edge is smaller than a height of the rear edge.

4. The paintball gun according to claim 1, wherein the partitioning means is in a sliding arrangement with the firing chamber.

5. The paintball gun according to claim 1, wherein the actuation means further comprises a pneumatic piston and a spring, characterized in that when the storage chamber contains the predetermined quantity of pressurized gas, the pneumatic piston and spring are depressed in response to the pressurized gas, thereby moving the partitioning means to the second position, and when the storage chamber does not contain the predetermined quantity of pressurized gas, the spring expands and moves the partitioning means and piston to the first position.

6. A bolt-less paintball gun for launching projectiles, comprising:

a projectile feed conduit having a plurality of projectiles;

a firing chamber for retaining at least a first projectile;

a movable partitioning means interposed between the firing chamber and the projectile feed conduit, characterized in that in a first position, an aperture is exposed, such that a first projectile passes from the feed conduit into the firing chamber, and in a second position, the aperture is covered and the first projectile located in the firing chamber is separated from a second projectile located in the projectile feed conduit, and the firing chamber is pneumatically sealed by the movable partitioning means;

an actuating means for alternately moving the movable partitioning means between the first and second positions;

a first valving means for providing a predetermined quantity of pressurized gas to a storage chamber; and a second valving means for rapidly transferring the predetermined quantity of pressurized gas from the storage chamber into the firing chamber, such that the first projectile is rapidly ejected from the firing chamber, a pressurized gas-source;

a regulating means with an input piston and seal and an output piston and seal arranged in opposition interposed between the pressurized gas source and a first valving means characterized in that in a first position gas passes from the pressurized gas source past an input piston and seal into a regulator chamber, in a second position gas is blocked from entering the regulator chamber by the input piston moving into a sealing arrangement, and in a third position an output piston moves out of a seal to release overpressure in the chamber as needed.

7. The paintball gun according to claim 6, wherein the regulating means provides a circumferential seal on the input piston.

8. The paintball gun according to claim 6, wherein the regulating means further comprises a means for the input piston to track with the output piston.

9. The paintball gun according to claim 6, wherein the regulating means comprises an adjustment means for restraining displacement movement of the output piston.

10. The paintball gun according to claim 6, wherein the pressurized gas causes a simultaneous movement to the output position which, in tracking, allows input piston to enter its seal.

11. The paintball gun according to claim 6, wherein the output piston can continue its movement independent of the input piston out of its seal effectively venting overpressure in the chamber.

12. The paintball gun according to claim 6, wherein the release of pressurized gas and the spring tension allows the output piston and input piston to return to original position.

13. A bolt-less paintball gun for launching projectiles, comprising:

a feed conduit a firing chamber for retaining at least a first projectile;

a propulsion means to eject a first projectile;

an actuating means for activating the propulsion means;

a projectile loading means, further comprising a generally flat partitioning device that separates projectiles using a movement means, such that a projectile that enters the firing chamber is separated and temporarily pneumatically sealed in the firing chamber.

14. The paintball gun according to claim 13, wherein the apparatus is selected from the group comprising a gun, a marker, or a launching device.

15. The paintball gun according to claim 13, wherein the actuating means further comprises a piston, characterized in that when actuated, the piston is depressed against a spring, thereby moving the partitioning means to the second position, and when released, the spring expands and moves the partitioning means and piston to the first position.

16. A method for cyclically operating a bolt-less paintball gun for pneumatically propelling a first projectile and automatically reloading and readying for firing a second projectile, comprising the step of:

1.) Supplying a first predetermined quantity of pressurized gas from a storage chamber to a firing chamber in response to an actuating means in order to rapidly eject a first projectile from the firing chamber and de-pressurize the storage chamber;

2.) moving a partitioning means to expose an aperture into the firing chamber in response to the de-pressurized storage chamber;

3.) allowing transfer of a second projectile from a feed conduit through the aperture to the firing chamber;

4.) supplying a second predetermined quantity of pressurized gas to the storage chamber, thereby pressurizing the chamber;

5.) moving the partitioning means to close the aperture into the firing chamber in response to the pressurized gas entering the storage chamber, thereby separating the second projectile from a third projectile and blocking the third projectile from entering the firing chamber and sealing the firing chamber; and 6.) providing a temporary pneumatic seal of the firing chamber.

17. A method for cyclically operating a movable partition apparatus to transfer a projectile from a loading chamber to a firing chamber of a bolt-less paintball gun, comprising the steps of:

1.) moving a partitioning means to expose an aperture in response to an activation means;

2.) remaining open to allow for a first projectile to transfer from the loading chamber to the firing chamber;

3.) moving to a closed position to cover an aperture after the projectile transfers into the firing chamber; and 4.) closing, a narrow front edge of the partitioning means interposes between the first projectile located in the firing chamber and a second projectile located in the loading chamber, the second projectile touching the first projectile, in a wedging arrangement that separates the first projectile from the second projectile and slightly lifts a second projectile.

* * * * *